US005649722A

United States Patent [19]

Champlin

[11] Patent Number: 5,649,722

[45] Date of Patent: Jul. 22, 1997

[54] CONVERTIBLE SNOWBOARD/SKIS

[76] Inventor: Jon F. Champlin, 241 S. Arthur, Pocatello, Id. 83201

[21] Appl. No.: 380,822

[22] Filed: Jan. 30, 1995

[51] Int. Cl.[6] ..... A63K 11/00

[52] U.S. Cl. ..... 280/818; 280/614; 280/14.2; 280/609

[58] Field of Search ..... 280/601, 604, 280/607, 609, 11.15, 611, 614, 617, 618, 633, 809, 814, 818, 14.2

[56] References Cited

U.S. PATENT DOCUMENTS

| | | | |
|---|---|---|---|
| D. 222,282 | 10/1971 | Hill . | |
| 2,326,802 | 8/1943 | Robinson et al. . | |
| 4,128,257 | 12/1978 | Zoor . | |
| 4,275,904 | 6/1981 | Pederson . | |
| 4,417,749 | 11/1983 | Napflin . | |
| 4,674,764 | 6/1987 | Miesen | 280/604 |
| 4,718,694 | 1/1988 | Brice et al. . | |
| 4,770,441 | 9/1988 | Demonsant et al. | 280/818 |
| 4,779,890 | 10/1988 | Mugnier | 280/601 |
| 4,871,186 | 10/1989 | Klosterman | 280/611 |
| 4,987,455 | 1/1991 | Tubens | 280/818 |
| 5,028,068 | 7/1991 | Donovan . | |
| 5,052,708 | 10/1991 | Matthews . | |
| 5,066,044 | 11/1991 | Adasek | 280/814 |
| 5,172,924 | 12/1992 | Barci | 280/607 |
| 5,318,320 | 6/1994 | Ramer . | |
| 5,344,177 | 9/1994 | Rouser et al. . | |
| 5,364,118 | 11/1994 | Burger et al. . | |

FOREIGN PATENT DOCUMENTS

| | | | |
|---|---|---|---|
| 430805-A | 6/1991 | European Pat. Off. . | |
| 2619019-A | 2/1989 | France . | |
| 2687078-A1 | 8/1993 | France . | |
| 3705507 | 9/1987 | Germany | 280/601 |
| 3628623 | 3/1988 | Germany | 280/818 |
| 681509-A5 | 4/1993 | Switzerland . | |

*Primary Examiner*—Brian L. Johnson
*Assistant Examiner*—Min Yu
*Attorney, Agent, or Firm*—Richard C. Litman

[57] ABSTRACT

A snowboard convertible into a pair of cross-country skis. The snowboard is characterized by joining a pair of cross-country skis together to form a snowboard and a removably mounted binding system positioned on the snowboard that is moveable between a snowboard position and a ski position. The binding system is operable in a cross-country skiing mode and a snowboarding mode when the skis are joined to form a snowboard. In an alternative embodiment of the snowboard, climbing attachments are removably attached to each ski to allow a skier to ski uphill.

3 Claims, 2 Drawing Sheets

CONVERTIBLE SNOWBOARD/SKIS

BACKGROUND OF THE INVENTION

1. Field of the Invention

The present invention relates to snowboards and skis.

2. Description of the Prior Art

The popularity of snowboarding is growing all over the world and is beginning to rival skiing as a recreational sport. In snowboarding, the person stands on the board with both feet and their body angled to the center or long axis of the board, similar to that observed in the use of a surfboard. The same snow covered slopes and surfaces are used as in skiing. An increasing number of snowboard users are turning to "backcountry snowboarding" —snowboarding that is done away from developed areas, usually in the mountains where there are no groomed slopes or trails or ski lifts. Backcountry snowboarding offers many advantages to the snowboarder, including, better quality snow—fresh powder—and no crowding on the ski trail.

However, backcountry snowboarding has one major disadvantage—the snowboarder must climb the mountain without assistance from a ski lift. Often, the snowboarder cross-country skis up the mountain, or uses snowshoes, while carrying the snowboard on his or her back. At the top of the mountain, the snowboarder removes the skis and descends the mountain on the snowboard, carrying the cross-country skis and poles, or snowshoes, on his or her back. This is an awkward and exhausting process for the snowboarder. No snowboard is seen in the prior art which allows the snowboarder to both snowboard and cross-country ski.

One of the main differences between the equipment used for snowboarding or downhill skiing and the equipment used for cross-country skiing is in the bindings. For snowboarding or downhill skiing, the user's boot is secured both at the toe and the heel to the snowboard or ski. Conversely, for cross-country skiing the ski boot is pivotable on the ski, generally at the toe of the boot, about an axis which is perpendicular to the normal direction of travel of the ski. Ski bindings suitable for both cross-country skiing and downhill skiing are well known. Typically, such bindings include a plate which is hinged at its front end and which can be rigidly secured at its rear end to the ski. Illustrations of bindings for both cross-country and downhill skiing may be seen in U.S. Pat. No. 4,128,257, issued to Zoor; U.S. Pat. No. 4,417,749, issued to Napflin; U.S. Pat. No. 4,718,6994, issued to Brice et al.; U.S. Pat. No. 5,318,320, issued to Ramer; and U.S. Pat. No. 5,364,118, issued to Burger et al.

Ski climbers or "skins" which are attached to the bottom of skis are well known. Ski climbers or skins allow the skier to move forward but not backward, thus enabling him or her to climb very steep slopes without having to side step, while still allowing the skier to glide forward downhill or on level terrain. Illustrations of ski climbers and skins may been seen in U.S. Pat. No. 2,326,802, issued to Robinson et al.; U.S. Pat. No. 5,052,708, issued to Matthews; and U.S. Pat. No. 5,344,177, issued to Rouser et al.

U.S. Pat. No. 4,275,904, issued to Pedersen, shows a mononose structure which converts a pair of conventional skis into a twin ski. The mononose structure is a tip which includes two pockets to hold the tips of the skis. The rear ends of the skis are tied together by a tail bridge at the tails of each of the skis. European Patent Office Patent Application No. 430,805, filed by Coffy, illustrates a coupling for parallel skis. The coupling consists of a curved front piece and a back piece. Parallel skis fit into hollows in the curved front piece. The back piece has a central part fitting between the skis and side parts which are shaped to fit over the top of the skis, behind the bindings. French Patent Application No. 2,687,078, filed by Salesse, shows skis fixed to a central beam to keep the skis parallel. Front and back bars are joined to the skis between the bindings and the ski ends by ball joints. This arrangement keeps the skis parallel but allows lateral movement of the skis. French Patent Application No. 2,619,019, filed by Charbonnier, illustrates plates used to join skis together as a monoski. The plates are joined to the skis by four axles held in supports fixed on the upper surfaces of the skis and the plates. None of the above referenced patents or patent applications teach or suggest a snowboard having bindings substantially perpendicular to the longitudinal axis of the snowboard and which is convertible to two separate skis having bindings parallel to the longitudinal axis of the skis.

Swiss Patent Application No. 681,509, filed by Bettenmann, shows a snowboard which can be divided lengthwise along a gap into a pair of skis. Detachably mounted bindings are positioned on the snowboard. Bettenmann does not teach or suggest a snowboard which can be divided into skis having a ski climbing means to enable the snowboarder to cross-country ski uphill. Additionally, Bettenmann lacks bindings which are suitable for both cross-country skiing and for snowboarding.

U.S. Design Pat. No. 222,282, issued to Hill, shows a design for a snowboard. The Hill patent does not teach or suggest a snowboard that is convertible into a pair of skis.

U.S. Pat. No. 5,028,068, issued to Donovan, shows an adjustable snowboard binding mechanism for pivotally mounting a snow boot binding on a snowboard and allows the binding to be changed in any direct thereafter. The Donovan patent does not teach or suggest a snowboard that is convertible into a pair of skis.

None of the above inventions and patents, taken either singly or in combination, is seen to describe the instant invention as claimed.

SUMMARY OF THE INVENTION

The present invention is directed to a snowboard which is convertible into a pair of cross-country skis. The snowboard is characterized by a means for joining a pair of cross country-skis together to form a snowboard and a removably mounted binding system positioned on the snowboard that is moveable between a snowboard position and a ski position. The binding system is operable in a first mode for cross-country skiing and a second mode for snowboarding when the skis are joined to form a snowboard. In an alternative embodiment of the snowboard, climbing attachments are removably attached to each ski to assist a skier in skiing uphill.

Accordingly, it is a principal object of the invention to provide a snowboard which is convertible into a pair of skis.

It is another object of the invention to provide a snowboard convertible to cross-country skis that is suitable for use in backcountry snowboarding.

It is a further object of the invention is to provide a snowboard convertible to cross-country skis having a binding system suitable for use in cross-country skiing and in snowboarding.

Still another object of the invention is to provide a snowboard convertible to cross-country skis that includes a climbing attachment to allow a skier to ski uphill.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
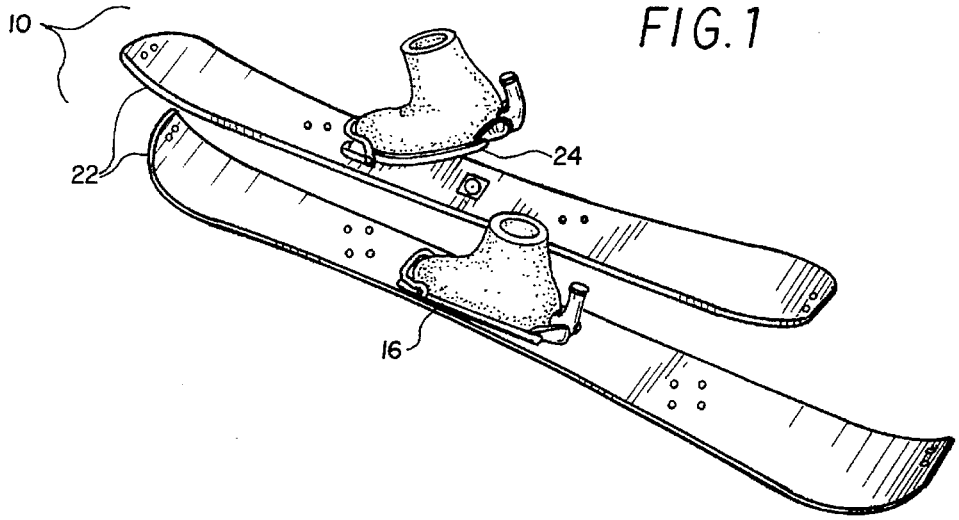
FIG. 1 is a perspective view of the invention showing the snowboard separated into a pair of skis and showing the bindings in the cross-country ski position.

A snowboard 10 convertible into cross-country skis is shown in FIG. 1. The major components of snowboard 10 are skis 12, means 14 for joining skis 12 to form snowboard 10, and binding system 16.

Figure 2:
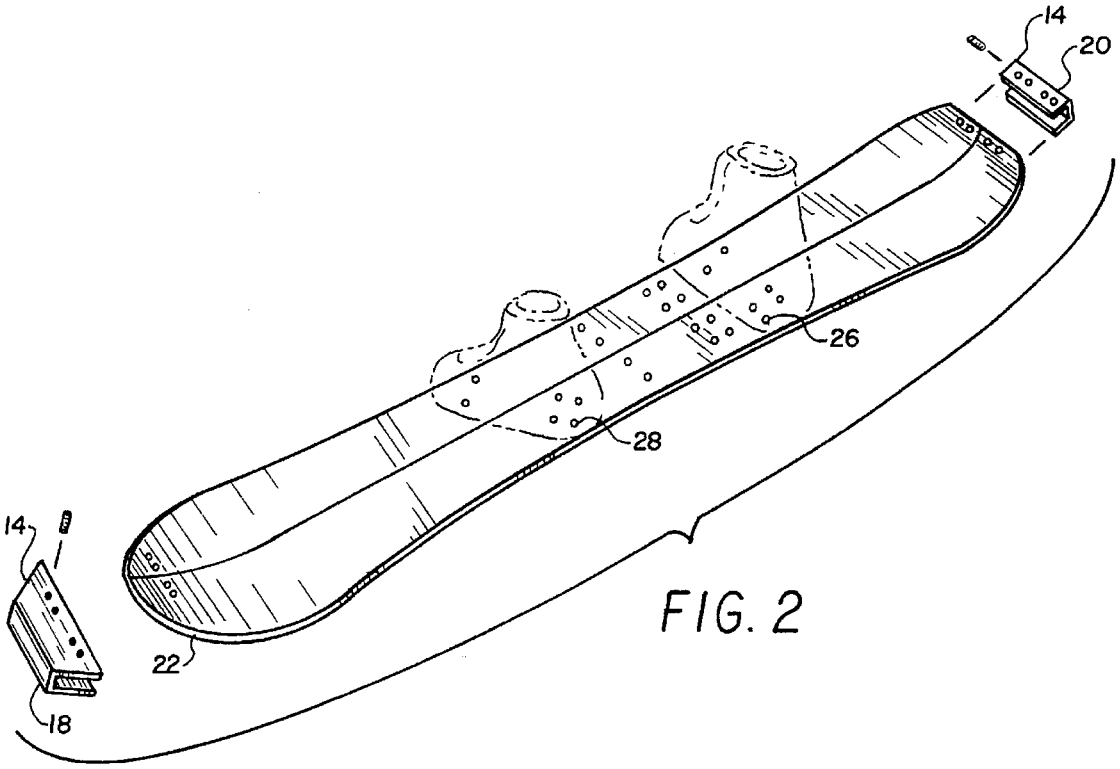
FIG. 2 is a perspective view of the invention showing the skis joined together to form a snowboard and showing the bindings in the snowboarding position.

FIG. 1 and FIG. 2 show a preferred embodiment of the invention in which means 14 for joining skis 12 comprise a front fastener 18 and rear fastener 20. Front fastener 18 is a bracket sized to fit over the front edge 22 of skis 12 when skis 12 are in an abutting relationship to form snowboard 10. Rear fastener 20 has a U-shaped cross-section and is sized to fit over the rear edge of skis 12 when skis 12 are in an abutting relationship. The fastening means 14 shown in the present embodiment of the invention are shown merely as an example and are not necessarily the only fastening means that would result in an operative embodiment. Other fastening means include bayonet connections having swivel locking elements fastened to the bottom of binding system 16, as disclosed in Swiss Patent Application No. 681,509, published Apr. 15, 1993, and incorporated herein by reference.

Binding system 16 consists of a pair of bindings 24 removably mounted on skis 12 such as by screws 30. Bindings 24 are selectively movable between a skiing position and a snowboarding position. In the skiing position, bindings 24 are positioned parallel to the longitudinal axis of skis 12. In the snowboarding position, the rear binding 26 is positioned perpendicularly to the longitudinal axis of snowboard 10. The front binding 28, is positioned at an angle to the longitudinal axis of snowboard 10. Additionally, front binding 28 and rear binding 26 serve to fasten skis 12 together when joined to form snowboard 10. FIG. 1 shows bindings 24 in the skiing position and FIG. 2 shows bindings 24 in the snowboarding position. The positions shown for bindings 24 in the present embodiment of the invention are shown merely as an example and are not necessarily the only positions that would result in an operative embodiment. In addition, adjustable snowboard binding mountings capable of being rotated with respect to the longitudinal axis of the snowboard, as shown in U.S. Pat. No. 5,028,068, incorporated herein by reference, may be used in conjunction with this invention.

Binding system 16 is selectively operable in a first mode for cross-country skiing and a second mode for snowboarding when said skis are joined to form a snowboard. Ski bindings suitable for cross-country skiing and downhill skiing are well known. Typically, such bindings include a plate which is hinged at its front end on the ski and which can be rigidly secured at its rear end to the ski. Examples of bindings suitable for both cross-country and downhill skiing may be seen in U.S. Pat. No. 4,128,257, issued to Zoor; U.S. Pat. No. 4,417,749, issued to Napflin; U.S. Pat. No. 4,718,6994, issued to Brice et al.; U.S. Pat. No. 5,318,320, issued to Ramer; and U.S. Pat. No. 5,364,118, issued to Burger et al, which are incorporated herein by reference. Alternatively, binding system 16 can consist of two separate bindings, a cross-country ski binding and a snowboard binding which are removably attached to the respective skis 12 and snowboard 10.

Figure 3:
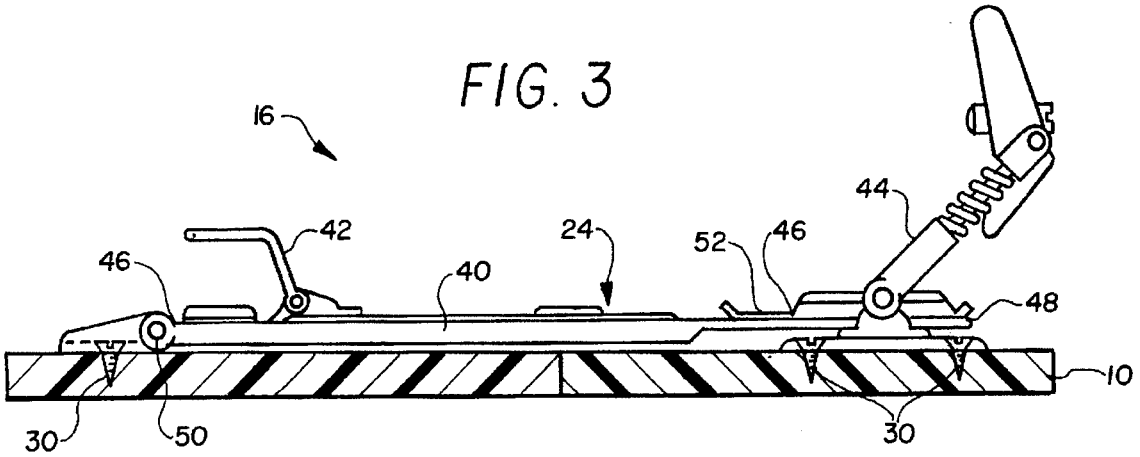
FIG. 3 is a side elevational view of the snowboard showing details of the bindings in the second mode with the heel locked down for snowboarding.

Referring to FIG. 3, each of bindings 24 includes a plate 40, a toe holder 42, a heel holder 44, and a means 46 for releasably securing plate 40 to skis 12 or snowboard 10. Toe holder 42 is sized to receive the toe of a user's boot and heel holder 44 is sized to receive the heel of a user's boot. Plate 40 has a front edge 46 and a rear edge 48. Plate 40 pivots about a horizontal axle 50 at front edge 46. Toe holder 42 is mounted on plate 40 at front edge 46. Heel holder 44 is mounted on rear edge 48. FIG. 3 shows a preferred embodiment of binding system 16 in which means 46 for releasably securing plate 40 is a latch arrangement 52. Preferably, latch arrangement 52 is located beneath rear edge 48 so as not to extend over the edge of snowboard 10 when bindings 18 are positioned for snowboarding.

Figure 4:
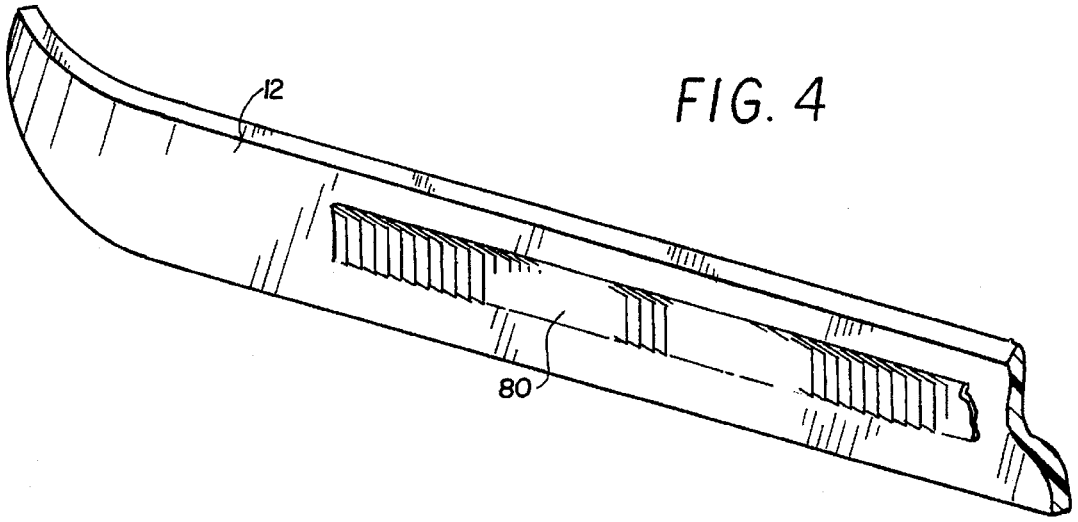
FIG. 4 is a perspective view of the invention showing details of the climbing skins attached to the bottom of a ski.

FIG. 4 shows climbing attachments 80 removably attached to a respective one of skis 12. Climbing attachments for skis which allow a skier to more easily climb up steep slopes are well known. Ski climbing fabrics or "skins", slant pile fabrics which are fastened to the underside of skis, traditionally have been used as ski climbing attachments. The commercial ski industry glues ski climbing fabrics to the ski or uses various mechanical attachment systems, including straps, to fasten ski climbing fabrics to skis. Examples of other climbing attachments may been seen in U.S. Pat. No. 2,326,802, issued to Robinson et al.; U.S. Pat. No. 5,052,708, issued to Matthews; and U.S. Pat. No. 5,344,177, issued to Rouser et al, which are incorporated herein by reference.

The present invention is ideal for backcountry snowboarding because it permits the snowboarder to snowboard without having to carry a separate pair of cross-country skis or snowshoes. To ascend a mountain, the snowboarder separates snowboard 10 into skis 12 and sets bindings 18 in the first or cross-country mode. In the cross-country mode, latch arrangement 52 is disengaged, releasing plate 40 and allowing it to pivot about axle 50. Additionally, ski climbing attachment 80 is attached to skis 12 to allow the snowboarder to more easily climb uphill.

Once the snowboarder reaches the top of the mountain, he or she joins skis 12 to form snowboard 10. Bindings 24 are placed in the snowboarding position and set in the second or snowboarding mode. In the snowboarding mode, latch arrangement 52 is engaged locking rear edge 48 of plate 40 against snowboard 10. The snowboarder is free to snowboard down the mountain without carrying skis or snowshoes on his back.

It is to be understood that the present invention is not limited to the sole embodiment described above, but encompasses any and all embodiments within the scope of the following claims.

I claim:

1. A snowboard convertible to cross-country skis comprising:

a pair of skis each having a front edge, a rear edge, and a longitudinal axis;

joining means for joining said skis to form a snowboard having a longitudinal axis, said joining means including, a front fastening bracket attached to the front edge of each ski;

a rear fastening bracket having a U-shaped cross-section attached to the rear edge of each said ski;

a pair of bindings positioned on said skis, each said binding including, a plate having a front end and a rear end, said plate connected to said skis through a pivot at said front end, a toe clamp atop said plate at said front end, a heel clamp atop said plate at said rear end, and means for releasably securing said rear end of said plate to said skis; and means for removably mounting said pair of bindings in dual positions including a snowboarding position in which each said binding is mounted to both said skis in a position generally perpendicular to said longitudinal axis of said snowboard and a skiing position in which each binding is mounted to one of said skis in a position substantially parallel to said longitudinal axes of said skis.

2. The snowboard according to claim 1, further comprising climbing attachments removably attached to a respective one of said skis for allowing a user to ski uphill.

3. The snowboard according to claim 2, wherein said climbing attachments are climbing skins.

* * * * *